United States Patent [19]

Bonin, Jr. et al.

[11] 4,266,537

[45] May 12, 1981

[54] PORTABLE PROGRESSIVE AND INTERMITTENT TRACTION MACHINE

[75] Inventors: Pete J. Bonin, Jr., San Juan Capistrano; Marion E. Evans, Orange; Pete J. Bonin, Sr., Newport Beach, all of Calif.

[73] Assignee: IMC International Management Consultants, Inc., New York, N.Y.

[21] Appl. No.: 816,818

[22] Filed: Jul. 18, 1977

[51] Int. Cl.[2] ..... A61H 1/02

[52] U.S. Cl. ..... 128/75

[58] Field of Search ..... 128/75, 84 R

[56] References Cited

U.S. PATENT DOCUMENTS

| | | | |
|---|---|---|---|
| 3,168,094 | 2/1965 | Siltamaki | 128/75 |
| 3,710,787 | 1/1973 | Rabjohn | 128/75 |
| 3,786,803 | 1/1974 | Petulla et al. | 128/75 |
| 3,847,146 | 11/1974 | Cushman | 128/75 |

*Primary Examiner*—John D. Yasko

*Attorney, Agent, or Firm*—Philip Rodman

[57] ABSTRACT

A portable traction machine for applying a traction force to a patient via a cord. The traction force may be applied either statically for a time set by a master timer or intermittently, the force alternating between pre-set maximum and minimum force levels. The time at each force level is independently controllable. In addition, intermittent or static traction may be applied progressively, in selected increments, where the amount of each increase and the time at each force level are independently adjustable. A novel means for sensing the force level in the cord for accurately controlling such force level is also disclosed.

14 Claims, 4 Drawing Figures

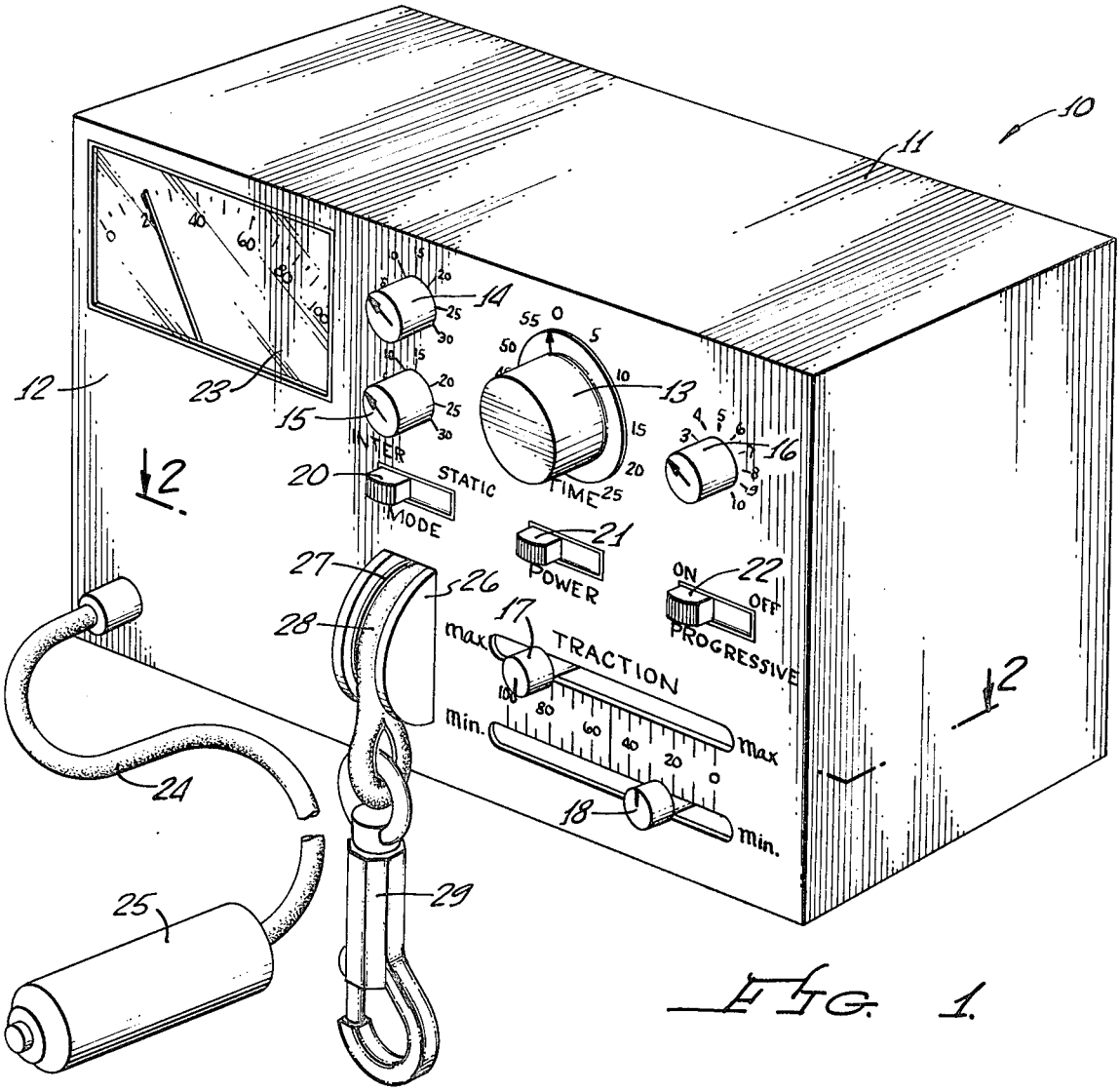
FIG. 1.
FIG. 2.
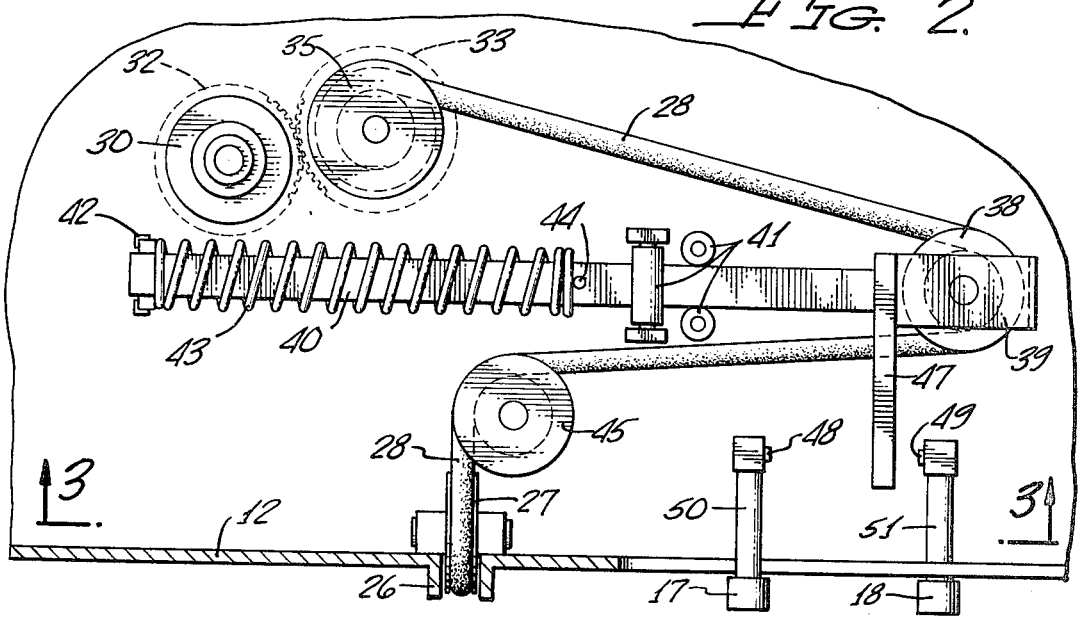

PORTABLE PROGRESSIVE AND INTERMITTENT TRACTION MACHINE

BACKGROUND OF THE INVENTION

1. Field of the Invention.

The present invention relates to a portable progressive and intermittent traction machine and, more particularly, to an electrically powered device for providing traction to a patient, intermittently or statically, between defined maximum and minimum force levels, and with a progressively increased force.

2. Description of the Prior Art.

In the field of physical therapy, traction has been used to eliminate patient pain and immobility of cervical, pelvic, arm, shoulder, leg, ankle, and neck joints, and related muscular disorders. Initially, traction was applied continuously, using a system of weights. Continuous traction assures a certain amount of immobilization of the joint and relieves muscle spasms. If correctly applied, it can achieve the desired result.

In the conventional method of application, the traction force level must be kept relatively low because the patient simply cannot tolerate high force levels for a long period of time. As a result, the conventional amount of weight that is used often does nothing more than to keep the patient still to some extent.

To overcome this problem, it has been proposed to use motorized intermittent traction to supplant all other methods of traction application. Intermittent traction relieves muscle spasms and has a massage-like affect upon the muscles and the ligamentous and capsular structures. It reduces swelling and promotes better circulation in the tissues. It prevents the formation of adhesions between the dural sleeves of the nerve roots and the adjacent capsular structures. Most importantly, with an intermittent force, the patient can tolerate a much higher force level and a better and faster result is achieved.

In order to provide intermittent traction, a number of portable intermittent traction machines have been designed, each of which including a cord and means for applying a force thereto for an amount of time set by a master timer. The machine typically can be operated in either a static or an intermittent mode. In the static mode, the force is increased to a set maximum force level where it is maintained for the time set in the master timer. In the intermittent mode, the force is alternately applied and released, the hold time and the rest time being independently set by separate timers.

Such known types of portable intermittent or static traction machines do not provide the full range of flexibility required to achieve the desired results in all cases. That is, the patient simply might not be capable of tolerating the full traction force at one time. Thus, it would be desirable to be able to progressively increase the force and to hold the force at each progressive level for a period of time before the force is again increased. Furthermore, in many cases, it is not necessary to completely reduce the force to zero on alternate cycles of an intermittent traction mode. Rather, it might be more appropriate to have the force alternate between a high and low, non-zero force level. Furthermore, the intermittent mode might also be combined with the progressive mode under many circumstances. A machine for operating in this manner has been unavailable heretofore.

Still further, existing machines do not provide a visual indication of the traction force being applied. They also do not include mechanisms for accurately controlling the force levels.

SUMMARY OF THE INVENTION

According to the present invention, there is provided a portable traction machine which solves these problems in a manner unknown heretofore. With the present machine, any desired traction force can be applied statically or intermittently, for a time set on a master timer. In the case of intermittent traction, the hold time and the rest time are independently adjustable. Also in the case of intermittent traction, the maximum force level and the minimum force level are independently adjustable and the minimum force level can be anything between the maximum force level and zero. A visual indication of the traction force is available. Furthermore, the traction force may be applied progressively, in increments from one to ten pounds, and the time of each cycle can be adjusted. Substantially greater patient comfort is achieved when applying traction in progressive steps.

Briefly, the present apparatus for applying a force to a patient via a cord comprises power means for applying a force to the cord; a first manual dial for setting a maximum force level; a second manual dial for setting a minimum force level; first drive means for activating the power means to increase the force in the cord until the force reaches the set maximum force level; a third manual dial for selectively setting a level of progressive increase of force level in the cord; a fourth manual dial for selectively setting a time at each progressive force level; means for deactivating the power means after each set progressive increase in the force level for the time set by the fourth manual dial; and second drive means for activating the power means to decrease the force in the cord in an intermittent mode when the force reaches the set maximum force level until the force reaches the set minimum force level.

OBJECTS

It is therefore an object of the present invention to provide a portable progressive and intermittent traction machine.

It is a further object of the present invention to provide a portable traction machine which provides progressive traction by itself or in combination with intermittent and/or static traction.

It is a still further object of the present invention to provide a progressive and intermittent traction machine which provides a continuous visual indication of the traction force.

It is another object of the present invention to provide a portable intermittent traction machine where the force can be alternated between predetermined maximum and minimum force levels.

It is still another object of the present invention to provide a portable traction machine in which the force level may be controlled accurately.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 1 is a perspective view of a portable intermittent and progressive traction machine constructed in accordance with the teachings of the present invention;

FIG. 2 is a partial sectional view taken along the line 2—2 in FIG. 1 and

DESCRIPTION OF THE PREFERRED EMBODIMENT

Figure 3:
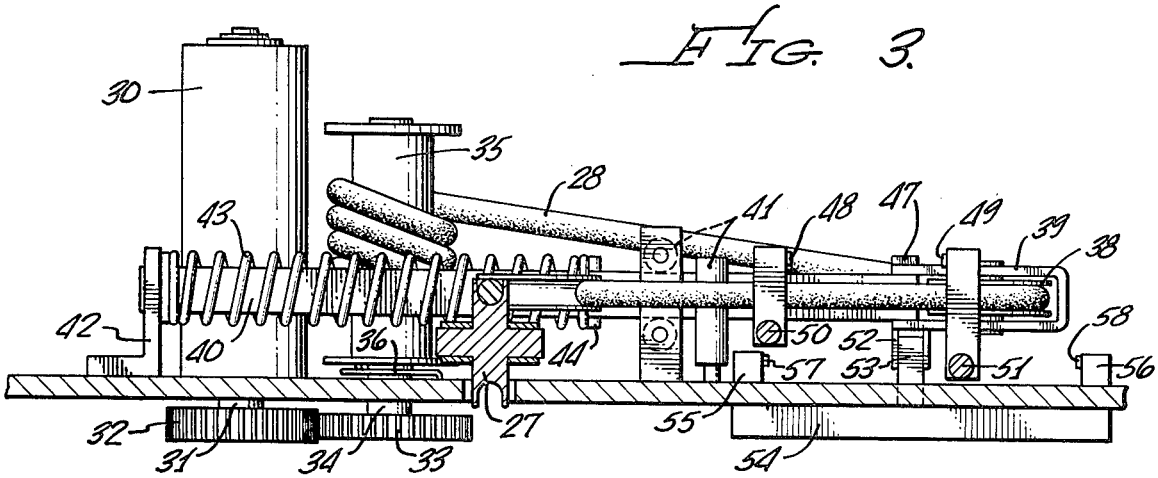
FIG. 3 is a partial sectional view taken along the line 3—3 in FIG. 2 showing the major mechanical components of the traction machine of FIG. 1.

Referring now to the drawings and, more particularly, to FIG. 1 thereof, the present portable traction machine, generally designated 10, may be housed in a convenient housing 11 for attachment to a stand, a wall, a table, or the like. All of the inputs and outputs of machine 10 appear on the front panel 12 of housing 11. Specifically, front panel 12 includes a rotary dial 13 for setting the total treatment time from zero to sixty minutes, a rotary dial 14 for setting the hold time for intermittent traction, a rotary dial 15 for setting the rest time for intermittent traction, a rotary dial 16 for setting the increment of force level increase for use in progressive traction, a slider 17 for setting the maximum traction force, and a slider 18 for setting the minimum traction force.

Front panel 12 of housing 11 also contains three two-position switches 20, 21, and 22, switch 20 selecting either a static mode or an intermittent mode, switch 21 turning power on or off, and switch 22 selecting either a progressive traction mode or a single force level traction mode. Also mounted on front panel 12 of housing 11 is a meter 23 for showing the actual traction force being applied during all traction modes. A cable 24 has one end connected to housing 11 and the other end connected to a switch 25 which functions as a patient override switch to terminate operation of traction machine 10.

Mounted on front panel 12 of housing 11 is a bracket 26 which rotatably supports a pulley 27, over which extends a cord 28. It is by means of cord 28 that machine 10 applies traction to a patient. For this purpose, cord 28 may terminate in a conventional snap latch 29.

Referring now to FIGS. 2 and 3, there is shown the major mechanical components of traction machine 10 for applying and controlling the force in cord 28. More specifically, traction machine 10 includes an electrical motor 30 having an output shaft 31 connected to a gear 32 which engages a gear 33 connected to a shaft 34. Shaft 34 supports a drum 35 on which cord 28 is wound. Also connected to drum 35 may be a spring 36 for retracting cord 28 when gears 32 and 33 are disengaged.

From drum 35, cord 28 is directed around a pulley 38 mounted on a bracket 39 connected to one end of a rod 40. Rod 40 is mounted for longitudinal movement by a plurality of roller bearings 41. The other end of rod 40 extends through a stationary pillow block 42 which supports one end of a spring 43. The other end of spring 43 contacts a pin 44 connected to rod 40. After extending around pully 38, cord 28 extends around a pulley 45 before extending through front panel 12 of housing 11 and around pulley 27.

It will be obvious that with snap latch 29 connected to a patient's traction harness, the rewind force of motor 35 applies a tension to cord 28 which is translated into a longitudinal force on rod 40. As motor 30 continues to wind cord 28 onto drum 35, pulley 38 moves towards pillow block 42 compressing spring 43. The amount of force in cord 28 is linearly proportional to the movement of rod 40 and motor 30 may be controlled by sensing this movement.

Connected to bracket 39 is an arm 47 positioned to contact either a microswitch 48 or a microswitch 49. Microswitches 48 and 49 are mounted for movement toward and away from each other by arms 50 and 51 which extend through front panel 12 of housing 11 and are controlled by sliders 17 and 18. Thus, as the operator moves sliders 17 and 18 to establish the maximum and minimum traction force levels, microswitches 48 and 49, respectively, are moved towards and away from arm 47. Accordingly, when motor 30 winds in cord 28 sufficiently to move push rod 40 by an amount to establish a tension level in cord 28 equal to the force set on slider 17, arm 47 contacts microswitch 48. Similarly, when motor 30 is driven in the opposite direction and relieves the tension in cord 28 to the point where the force level thereof equals the force level set on slide 18, arm 47 contacts microswitch 49.

Bracket 39 also supports another arm 52 which engages the movable slide 53 of a potentiometer 54. As will be described more fully hereinafter, potentiometer 54 can be utilized to provide an electrical signal to meter 23 which presents a real time visual indication of the traction force being applied to the patient by means of cord 28.

Also mounted in the proximity of potentiometer 54 are a pair of brackets 55 and 56 which support microswitches 57 and 58, respectively. Microswitches 57 and 58 are utilized to set maximum and minimum force levels, respectively, and are positioned to be contacted by arm 52 when these force levels are achieved. As will be described more fully hereinafter, these microswitches will trigger the electronic circuitry when the maximum and minimum excursions of the traction force exerted to rod 40 and its associated moving parts is reached.

When power switch 21 is placed in the on condition, power may be applied to motor 30 for driving shaft 31 and gear 32. When dial 13 of the treatment timer is turned away from zero, gears 32 and 33 are engaged so that motor 30 may rotate drum 35 for winding cord 28 onto itself, pulling cord 28 along pulleys 38, 45, and 27.

Figure 4:
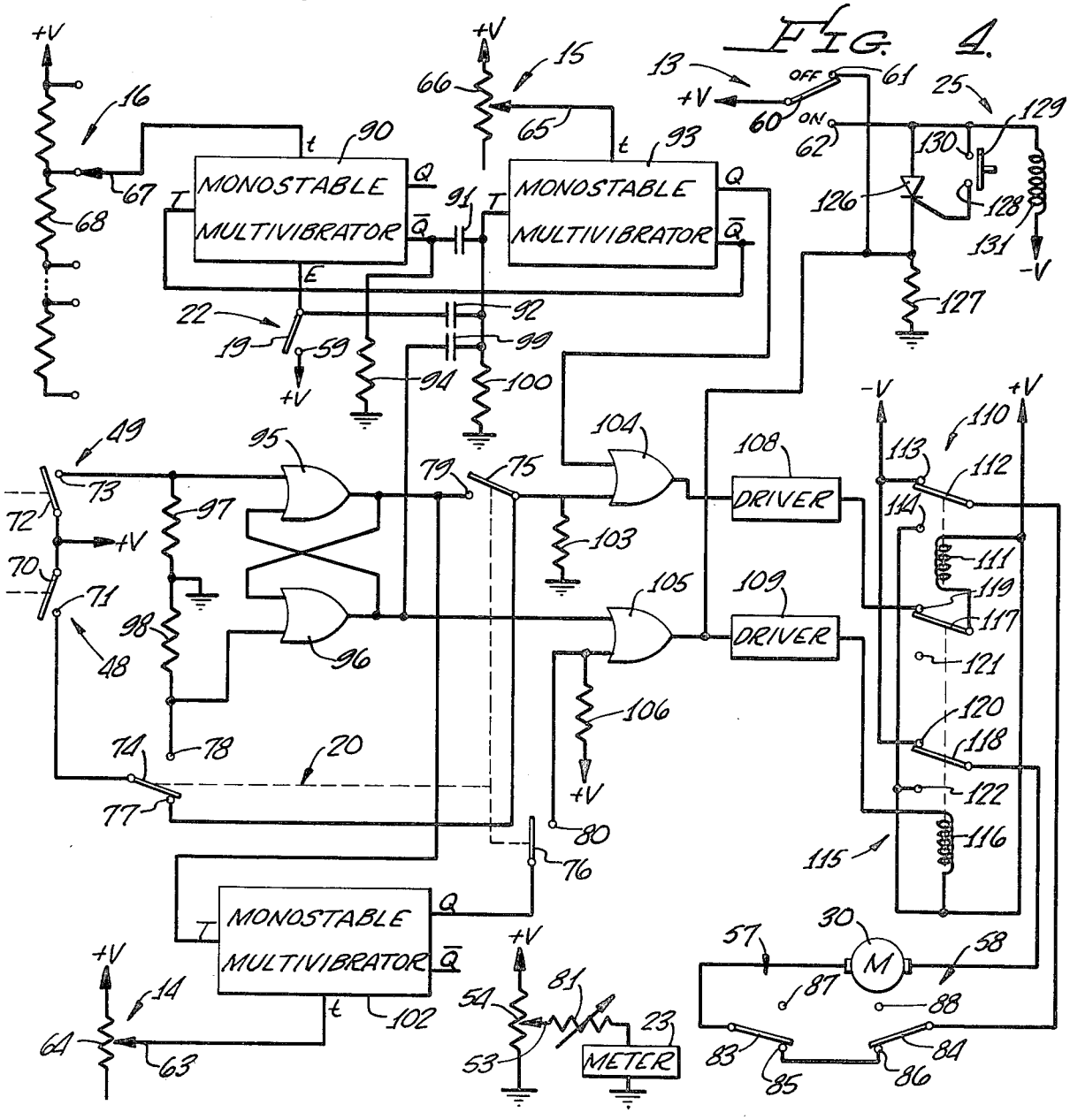
FIG. 4 is a block diagram of the electrical components of the traction machine of FIG. 1.

Referring now to FIG. 4, there is shown the electrical components of traction machine 10. The electrical circuit includes multiple switches which have been numbered to correspond to the mechanical functions shown in FIGS. 1–3. Thus, timer 13 is part of a switch which includes a movable arm 60 which is connected to a source of positive voltage V+. Arm 60 is capable of contacting a terminal 61 when the treatment time is zero or a terminal 62 at any other time. Dial 14 is connected to the arm 63 of a potentiometer 64, one end of which is connected to V+. Dial 15 is connected to the arm 65 of a potentiometer 66, one end of which is connected to V+. Dial 16 is connected to the arm 67 of a ten-position rotary or linear potentiometer 68, one end of which is connected to V+. Thus, the position of dial 16 determines the position of arm 67 and the amount of resistence connected between arm 67 and V+.

Microswitch 48 is connected to an arm 70 which contacts a terminal 71 when arm 47 contacts microswitch 48. Similarly, microswitch 49 is connected to an arm 72 which contacts a terminal 73 when arm 47 contacts microswitch 49. Mode selector switch 20 is connected to three arms 74, 75, and 76 which are mechanically inter-connected for simultaneous movement. In the static mode, arm 74 contacts a terminal 77 whereas arms 75 and 76 are open. In the intermittent mode, arms 74, 75 and 76 contact terminals 78, 79, and 80, respectively.

Progressive selection switch 22 is connected to an arm 19 which contacts, in the progressive mode, a terminal 59 connected to V+. Potentiometer 54 is connected between V+ and ground. Slider 53 is connected via a variable calibration resistor 81 to meter 23. Microswitches 57 and 58 are connected to arms 83 and 84, respectively, which are normally connected to interconnected terminals 85 and 86, respectively. On the other hand, if arm 52 contacts either switch 57 or 58, arm 83 or 84, respectively, is moved into contact with a terminal 87 or 88, respectively.

Completing the description of the electrical components of machine 10, arm 67 is connected to the timing input t of a monostable multivibrator 90 which is operative only when a positive voltage is applied to its enable input terminal E. Terminal E is connected to arm 19 which, therefore, enables multivibrator 90 when arm 19 is moved into contact with terminal 59. The $\overline{Q}$ output of multivibrator 90 is connected to ground via a resistor 94 and via a series capacitor 91 to the trigger input terminal T of a second monostable multi-vibrator 93, which receives another input from arm 19 via a capacitor 92. Arm 65 of potentiometer 66 is connected to the timing input t of multivibrator 93. The $\overline{Q}$ output of multivibrator 93 is connected to the trigger input terminal T of multivibrator 90.

Arms 70 and 72 are connected to V+ and terminal 71 is connected to arm 74. Terminal 73 is connected to one input of a NOR gate 95 whereas terminal 78 is connected to one input of a NOR gate 96. Terminal 73 is connected via a resistor 97 to ground whereas terminal 78 is connected via a resistor 98 to ground. The output of NOR gate 95 is connected to the other input of NOR gate 96 whereas the output of NOR gate 96 is connected to the other input of NOR gate 95. The output of NOR gate 96 is also connected via a capacitor 99 to the trigger input terminal T of multivibrator 93. A resistor 100 is also connected between trigger input terminal T of multivibrator 93 and ground.

Arm 63 of potentiometer 64 is connected to the timing input terminal t of a monostable multivibrator 102. The output of NOR gate 95 is connected to the trigger input terminal T of multivibrator 102. The Q output of multivibrator 102 is connected to arm 76.

Arm 75 is connected to terminal 77, to one end of a resistor 103, the other end of which is connected to ground, and to one input of a NOR gate 104 which receives its other input from the Q output of multivibrator 93. The output of NOR gate 96 is connected to one input of a NOR gate 105, the other input of which is connected to terminal 80 and to one end of a resistor 106, the other end of which is connected to V+. The output of gate 104 is connected to a relay driver 108 whereas the output of gate 105 is connected to a relay driver 109. Driver 109 also receives an input from terminal 61 of switch 13.

A relay 110 includes a coil 111 and an arm 12 which may contact either a terminal 113 when coil 111 is unenergized or a terminal 114 when coil 111 is energized. A relay 15 includes a coil 116 and a pair of arms 117 and 118 which contact terminals 119 and 120, respectively, when coil 116 is unenergized and terminals 121 and 122, respectively, when coil 116 is energized. Terminals 113 and 120 are connected to a source of negative voltage V− whereas one end of coil 111, one end of coil 116, and terminals 114 and 122 are connected to V+. The output of driver 108 is connected to terminal 119 whereas the output of driver 109 is connected to the other end of coil 116. The other end of coil 111 is connected to arm 17. Arm 112 is connected to arm 84 whereas arm 118 is connected to one end of motor 30, the other end of which is connected to arm 83.

Terminal 62 is connected via an SCR 126 to the input of driver 109 and to one end of a resistor 127, the other end of which is connected to ground. The control electrode of SCR 126 is connected to a terminal 128 which may be contacted by an arm 129 when switch 25 is closed. When switch 25 is closed, arm 129 also contacts a terminal 130 which is connected to terminal 62. Terminal 62 is also connected to one end of a solenoid 131, the other end of which is connected to V−. Thus, when timer 13 is turned on, solenoid 131 is activated to engage gears 32 and 33.

OPERATION

In operation, machine 10 can operate in four different modes, depending upon the positions of switches 20 and 22. Accordingly, the four different modes of operation will be described separately.

In the static mode, with the progressive function inoperative, multivibrators 90, 93, and 102 are inoperative. Switch 22 is open, as are arms 75 and 76 of switch 20. Arm 74 of switch 20 is in contact with terminal 77.

In this mode, the output of gate 105 is held low by the positive voltage applied to one input terminal thereof. Accordingly, driver 109 is blocked from energizing relay 115 which, when energized, drives motor 30 to decrease the force on cord 28. On the other hand, both inputs to NOR gate 104 are low. This occurs because one input is connected via resistor 103 to ground and the other input is connected to the Q output of multivibrator 93, which Q output is normally low. As a result, the output of gate 104 is high, and driver 108 energizes relay 111 through arm 117 of relay 115. It should be noted that by conducting the output of driver 108 to coil 111 through an arm of relay 115, it would be impossible to energize coil 111 once coil 116 is energized.

In any event, coil 111 moves arm 112 of relay 110 into contact with arm 14. Under these circumstances, one end of motor 30 is connected to V− via arm 118 and terminal 120, whereas the other end of motor 30 is connected to V+ via arms 83, 84, and 112 and terminal 114. Motor 30 is therefore energized into an increase traction mode until arm 47 connected to bracket 39 contacts micro-switch 48. Closing of microswitch 48 moves arm 70 into contact with terminal 71, connecting V+ to one input of gate 104 via arm 70, terminal 71, arm 74, and terminal 77. Since one input to gate 104 is now high, the output goes low, removing the voltage from driver 108 and de-energizing coil 111 of relay 110.

Machine 10 will maintain this maximum setting until the end of the timing cycle, whereupon arm 60 of switch 13 moves into contact with terminal 61, applying V+ to driver 109. This energizes coil 116 of relay 15, moving arms 117 and 118 into contact with terminals 121 and 122, respectively. This reverses the voltage across motor 30 and drives motor 30 until it reaches a zero force level.

In the static mode, with the progressive function operative, arm 19 of switch 22 is moved into contact with terminal 59, enabling multivibrators 90 and 93. In this mode, multivibrator 90, in combination with potentiometer 68, determines the amount of incremental force increase whereas multivibrator 93, in combination with potentiometer 66, determines the time that each force is held before the force increases.

In this mode, and as described previously, the high signal from V+ through resistor 106 at one input to NOR gate 105 blocks any energizing of driver 109 and coil 116 of relay 115. Machine 10 will complete any previous function and return to a point where arm 47 connected to bracket 39 contacts microswitch 49. This closes arm 72 into contact with terminal 73, providing a positive voltage to one input of NOR gate 95. Because of the interconnection of the inputs and outputs of NOR gates 95 and 96, when the output of one is driven high the output of the other will be driven low. The closing of switch 72 drives the outputs of gates 95 and 96 low and high, respectively, and, if this causes a change in the output of gate 96, the transition is converted to a pulse by capacitor 99 and resistor 100. If the output of gate 96 is already high, so that no transition occurs, a pulse will still be generated by capacitor 92 upon the closing of switch 22. Either pulse triggers multivibrator 93 which inverts. When multivibrator 93 inverts, the Q output goes high, driving the output of gate 104 low and de-energizing driver 108. Accordingly, motor 30 will remain e-energized until multivibrator 93 returns to its quiescent condition. The time that this will take is determined by the position of arm 65.

When multivibrator 93 returns to its quiescent state, the Q output thereof goes low and since both inputs to gate 104 are now low, driver 108 is activated to energize coil 111 of relay 110 to apply a voltage across motor 30 to increase the traction force. At the same time, the $\overline{Q}$ output of multivibrator 93 going high triggers multivibrator 90, causing the $\overline{Q}$ output thereof to go low. At the end of the timing cycle of multivibrator 90, which is determined by the position of arm 67, multivibrator 90 will return to its normal quiescent state, whereupon the positive transition at the $\overline{Q}$ output thereof is converted to a pulse by capacitor 91 and resistor 94 to trigger multivibrator 93. The change in state of multivibrator 93 causes a high signal to be applied to one input of gate 104, to deactivate driver 108 so that the force increase mode is interrupted for an amount of time set by potentiometer 66 and arm 65 thereof.

This sequence will continue until arm 47 contacts microswitch 48, moving arm 70 into contact with terminal 71. When this occurs, a high signal is applied to one input of gate 104, holding the output thereof low even though multivibrators 90 and 93 continue to cycle. Accordingly, machine 10 maintains the maximum traction setting until, as explained previously, timer 13 runs out and driver 109 is activated to energize coil 116 of relay 115 to reverse motor 30.

In the intermittent mode of operation, switch 20 will move arm 74 into contact with terminal 78, arm 75 into contact with terminal 79, and arm 76 into contact with terminal 80. With the progressive function inoperative, multivibrator 90 is deactivated by switch 22. Gates 95 and 96 are now in the circuit, as is multivibrator 102. If the unit is in any function other than at rest, the unit will complete its initial cycle and will return to rest, which condition causes arm 47 to contact microswitch 49, thereby moving arm 72 into contact with terminal 73.

The closing of switch 49 causes the output of gate 96 to go high. This transition is differentiated by capacitor 99 and resistor 100 to generate a pulse which triggers multivibrator 93. The low signal at the Q output of multivibrator 93 inhibits gate 104 so that the motor is maintained at its minimum setting for the time determined by the position of arm 65 of potentiometer 66.

The moment multivibrator 93 inverts, the Q output thereof goes low so that the output of gate 104 goes high, activating driver 108 and energizing coil 111 of relay 110 to drive motor 30 in the force increase mode. This action will continue until arm 47 contacts microswitch 48, moving arm 70 into contact with terminal 71. When this occurs, a high signal is applied to one input of gate 96, causing the output thereof to go low, which drives the output of gate 95 high. This high signal is applied via arm 75 to gate 104, thereby blocking any effort of multivibrator 93 to activate driver 108. Motor 30 is therefore deactivated. Simultaneously, the transition at the output of gate 95 activates multivibrator 102, the Q output of which goes high, applying a high signal to one input of gate 105. The other input thereto, from gate 96 is low.

At the end of the timing cycle of multivibrator 102, which is determined by the position of arm 63 of potentiometer 64, the Q output goes low and, since both inputs to gate 105 are now low, the output goes high, activating driver 109 and energizing coil 116 of relay 115. As explained previously, this provides a reverse voltage to motor 30 which is therefore driven in a direction to decrease the force on cord 28. This mode will continue until arm 47 contacts microswitch 49, moving arm 72 into contact with terminal 73. When this occurs the above cycle repeats and after the predetermined rest period determined by the position of arm 65 of potentiometer 66, driver 108 is activated to drive motor 30 in the force increase mode.

In the intermittent mode, as described previously, switch 22 may be closed to enable multivibrator 90. In this mode, the force increases in steps, where potentiometer 68 determines the force increment and potentiometer 66 determines the time at each increment, until the maximum force is reached, at which time potentiometer 64 determines the amount of time that the maximum force is sustained. At the end of that maximum force interval, the force will decrease to the minimum force setting where it will stay for an amount of time determined by the position of arm 65 of potentiometer 66. Thereafter, the force will again increase in increments until the maximum force is reached.

More specifically, machine 10 will complete any sequence previously engaged and then return to rest. When arm 72 contacts terminal 73, the outputs of gates 95 and 96 are driven low and high, respectively, as described previously, and multivibrator 93 is inverted. By driving the Q output of multivibrator 93 high, the output of gate 104 goes low and driver 108 is deactivated.

When multivibrator 93 reaches the end of its timing interval, as established by the position of arm 65 of potentiometer 66, the Q output goes low and driver 108 is activated. This places motor 30 into a force increase mode. At the same time, multivibrator 90 is pulsed by the transition at the $\overline{Q}$ output of multivibrator 93. Accordingly, the increase traction mode will continue only until multivibrator 90 inverts and applys a set signal to multivibrator 93. This deprives driver 108 of its activating signal so that the force increase mode is interrupted. Accordingly, the force will remain at a constant level until multivibrator 93 again inverts. When this occurs, the sequence is repeated. It is, therefore, seen that the amount of force increase increment is established by the position of arm 67 of potentiometer 68 and the amount of time that the force is held at each level is determined by the position of arm 65 of potentiometer 66.

This sequence continues until maximum rest switch 48 causes arm 70 to contact terminal 71. As explained previously, this causes gates 95 and 96 to invert, driving the output of gate 104 low and depriving drive 108 of an energizing signal regardless of the operation of multivibrators 90 and 93. Since gate 96 is now low, a low input is connected to one input of gate 105. On the other hand, multivibrator 102 is inverted, causing the Q output thereof to go high, maintaining the output of gate 105 low. On the other hand, when multivibrator 102 returns to its quiescent state, both inputs to gate 105 are now low and relay 115 is energized by driver 109, placing motor 30 in a decrease traction mode until arm 47 contacts microswitch 49, moving arm 72 into contact with terminal 73. At this time, the sequence repeats.

Machine 10 has two override functions, one operated by the patient and the other operated by switch 13. These override functions supersede all other functions. The patient override function may be engaged by depression of the patient switch 25 which moves arm 129 into contact with terminals 128 and 130. Assuming switch 13 is otherwise on, V+ is connected to the control terminal of SCR 126 via arm 129, latching SCR 126 into a conducting state. This provides an activating voltage to driver 109 which energizes relay 115 to place motor 30 in a decrease traction mode, which may be stopped only by opening minimum switch 57. At this point, the machine 10 will not increase traction until master timer 13 is turned to the off position, removing the latch from across SCR 126.

Turning meter timer 13 off provides drive to decrease relay 115, simultaneously disengaging gear solenoid 131. Turning timer 13 on will always engage gear solenoid 131. When it is de-energized, spring 36 will rewind cord 28.

It can therefore be seen that according to the present invention, there is provided a portable traction machine 10 which solves the problems encountered heretofore. With machine 10, any desired traction force can be applied statically or intermittently, for a time set by master timer 13. In the case of intermittent traction, the hold time and the rest time are independently adjustable by manipulating dials 14 and 15. Also in the case of intermittent traction, the maximum force level and the minimum force level are independently adjustable by slides 17 and 18 and the minimum force level can be anything between the maximum force level and zero. A visual indication of the traction force is available on meter 23. Furthermore, the traction force may be applied progressively, in increments from one to ten pounds, and each cycle can be adjusted to last for a time established by rest timer 15.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment but only by the scope of the appended claims.

I claim:

1. A traction machine for applying a force to a patient comprising:

a cord adapted to receive a traction harness at one end thereof;

power means coupled to said cord for applying a force thereto;

means for sensing the level of said force in said cord;

first manual means for setting a maximum force level;

first drive means responsive to said first manual means and said sensing means for activating said power means in a force increase direction until said force reaches said set maximum force level;

second manual means for selectively setting a level of progressive increase of force level in said cord;

third manual means for selectively setting a time at each progressive force level; and means responsive to said second and third manual means for intermittently deactivating said power means after each set progressive increase in said force level for the time set by said third manual means, said power means maintaining said force on said cord during said time set by said third manual means, said power means being operative, at the end of said time set by said third manual means, to increase said force level in said cord, whereby said force is applied continuously and progressively until said force reaches said set maximum force level.

2. A traction machine according to claim 1, further comprising:

fourth manual means for setting a minimum force level; and second drive means responsive to said fourth manual means and said sensing means for selectively activating said power means in a force decrease direction when said force reaches said maximum force level until said force reaches said set minimum force level.

3. A traction machine according to claim 2, wherein said first drive means deactivates said second drive means during the operation thereof and said second drive means deactivates said first drive means during the operation thereof.

4. A traction machine according to claim 2, wherein said minimum force level is adjustable between zero and said set maximum force level.

5. A traction machine for applying an intermittent force to a patient comprising:

a cord adapted to receive a traction harness at one end thereof;

power means coupled to said cord for applying a force thereto;

means for sensing the level of said force in said cord;

first manual means for setting a variable maximum force level;

second manual means for setting a variable minimum force level;

first drive means responsive to said first manual means and said sensing means for selectively activating said power means in a force increase direction until said force reaches said set maximum force level; and second drive means responsive to said second manual means and said sensing means for selectively activating said power means in a force decrease direction when said force reaches said maximum force level until said force reaches said set minimum force level.

6. A traction machine according to claim 5, wherein said first drive means deactivates said second drive means during the operation thereof and said second drive means deactivates said first drive means during the operation thereof.

7. A traction machine according to claim 5, wherein said minimum force level is adjustable between zero and said set maximum force level.

8. A traction machine according to claim 5, wherein said power means comprises:

a drum for winding and unwinding said cord; and a motor for selectively driving said drum; and further comprising:

a pulley around which said cord extends;

a rod mounted for longitudinal movement, said pulley being connected to one end of said rod so that an increase in the force in said cord moves said rod in a first direction; and a spring for urging said rod in a second direction, opposite to said first direction; and wherein said force level sensing means comprises:

means for sensing movement of said rod.

9. A traction machine according to claim 8, wherein said rod movement sensing means comprises:

an arm connected to said rod or said pulley for movement therewith;

first movable switch means positioned to contact said arm during movement of said pulley in said first direction, said first switch means being operatively connected to said first manual means; and second movable switch means positioned to contact said arm during movement of said pulley in said second direction, said second switch means being operatively connected to said second manual means.

10. A traction machine according to claim 9, wherein said arm closes said first or second switch means upon contacting same to provide an electrical signal to said motor to operate same.

11. A traction machine according to claim 8, wherein said sensing means comprises:

an arm connected to said pulley or said rod for movement therewith;

a stationary potentiometer having a movable wiper; and means for connecting said arm to said wiper whereby said potentiometer provides an output indicative of the force in said cord.

12. A traction machine according to claim 11, further comprising:

a visual meter connected to the output of said potentiometer for providing a visual indication of said force in said cord.

13. A traction machine according to claim 6 further including third manual means for setting a time duration at said set maximum force level, fourth manual means for setting a time duration at said set minimum force level and fifth manual means for setting a treatment time in excess of the time durations at said maximum and minimum force levels to permit said first and second drive means to operate intermittently.

14. A traction machine according to claim 2 further including fifth manual means for setting a time duration at said set maximum force level, said minimum force level being maintained for a time duration set by one of said fourth and fifth manual means, and sixth manual means for setting a treatment time in excess of the time duration required for progressive build up of said force to said set maximum force level and for maintenance of said set maximum force level and for maintenance of said set minimum force level to permit intermittent repetition of the cylcles of progressive build up of said force to said maximum force level and reduction of said maximum force level to said minimum force level.

* * * * *